US009194146B2

(12) United States Patent
Murphy

(10) Patent No.: US 9,194,146 B2
(45) Date of Patent: Nov. 24, 2015

(54) WAKE SURF POOL WITH CENTRAL ROTATING FOILS

(71) Applicant: Douglas Murphy, Glascow (GB)

(72) Inventor: Douglas Murphy, Glascow (GB)

( * ) Notice: Subject to any disclaimer, the term of this patent is extended or adjusted under 35 U.S.C. 154(b) by 261 days.

(21) Appl. No.: 13/662,217

(22) Filed: Oct. 26, 2012

(65) Prior Publication Data

US 2014/0115769 A1 May 1, 2014

(51) Int. Cl.

| | |
|---|---|
| ***E04H 4/00*** | (2006.01) |
| ***A63G 31/00*** | (2006.01) |
| ***A63B 69/00*** | (2006.01) |

(52) U.S. Cl.

CPC ..... *E04H 4/0006* (2013.01); *A63B 69/0093* (2013.01); *A63G 31/007* (2013.01)

(58) Field of Classification Search

CPC ..... E04H 4/0006
USPC ..... 4/491
See application file for complete search history.

(56) References Cited

U.S. PATENT DOCUMENTS

| | | | | |
|---|---|---|---|---|
| 4,792,260 | A * | 12/1988 | Sauerbier | 405/79 |
| 6,019,547 | A * | 2/2000 | Hill | 405/79 |
| 6,920,651 | B2 | 7/2005 | Roberts | |
| 8,042,200 | B2 | 10/2011 | Webber | |
| 2013/0074254 | A1 * | 3/2013 | Payne et al. | 4/491 |

* cited by examiner

*Primary Examiner* — Huyen Le
*Assistant Examiner* — Christine Skubinna
(74) *Attorney, Agent, or Firm* — Greenberg Traurig

(57) ABSTRACT

A wave pool configured to generate waves from a center portion of the wave pool towards the outer perimeter of the wave pool. A motor is positioned substantially at a center of the wave pool and is connected to a foil via an arm extending outwardly from the motor. The motor causes rotation of the arm and the foil for generating waves that travel away from the motor and towards an outer edge of the pool. The foil may be formed in the shape of a scoop and configured to adjust its angle relative to the arm via one or more angular adjustment connections with the arm. Multiple arms and/or foils may be used to generate waves in the wave pool. The wave pool has a deeper body of water located adjacent to the motor and a shallower body of water adjacent to the outer perimeter.

7 Claims, 9 Drawing Sheets

WAKE SURF POOL WITH CENTRAL ROTATING FOILS

BACKGROUND

1. Field

The present invention relates generally to wave pools or water attractions. More particularly, the present invention relates to wave pools having centrally located wave generating devices for creation of surfing wakes.

2. Description of the Related Art

Wave pools have become a popular form of entertainment for patrons of waterparks and other entertainment venues. When a standard pool is outfit with motors, pumps, or other wave-generating equipment, the normally static pool water can be altered into an exciting and dynamic environment for both swimmers and tubers alike. In addition, bystanders relaxing outside of the pool are treated to a more interesting environment for viewing when swimmers and tubers are negotiating the waves.

Surfing machines have also proven a popular attraction, both for entertainment and for training purposes to help instruct individuals that may be wary or otherwise unable to surf out in the ocean. Conventional surf machines utilize water pumps cooperating with nozzles or jets to flow water over a variety of surfaces, allowing riders to skim atop the water flow. Still other surf devices operate in much deeper bodies of water, such as wave pools, essentially mimicking the effects and feeling of surfing in the deep ocean water. Unfortunately, the cost to design and manufacture such deep water wave pools with adequate waves for surfing has proven to be costly, limiting their install base. Moreover, the size of the water pumps or other wave generating components are typically very large and expensive to repair and maintain, in addition to the cost stemming from their high energy and power consumption.

The waves generated commonly initiate at one end of the pool or body of water and travel towards the opposite end. Such a configuration leads to a waste of many ride-able waves since riders may be required to paddle or navigate through oncoming waves, much like in an ocean setting, before arriving at the wave origination location to ride one of the waves towards shore. In response, certain configurations have been proposed for wave pools wherein wave-generating devices, such as hulls, paddles or pneumatic equipment, are positioned and/or move along an exterior circumference or perimeter of a pool and direct waves towards or around a shallow or protruding shore located in the center of the pool. In these designs, the pool is deepest around its circumference and shallowest at its center.

Unfortunately, such designs are not ideal for a variety of reasons. Firstly, positioning the wave-generating devices and the deepest water around the perimeter of the wave pool makes entering or leaving the pool more difficult, for example, requiring the use of bridges or tunnels to bring potential wave riders to the shallow center. Secondly, a traveling displacement hull around the deep water, outer circumference of the pool to generate waves also imparts movement to the entire pool, causing the water to also rotate in harmony with the hull and reduce its effectiveness. Thirdly, pools built with deep-water outer perimeters fail to provide the desired visibility for spectators or other bystanders who do not wish to ride the waves in the pool, instead opting to remain adjacent to the pool but still watch the activity within. This is particularly apparent for parents who desire to keep an eye on the safety of their children, but may not want to enter the shallow portion in the center of the pool itself. Indeed, the shallow portion may not be large enough to accommodate the vast quantity of potential bystanders that typically sunbathe adjacent to wave pools at many water park venues. Lastly, the exterior-positioned wave generation devices are complex in nature, inherently requiring a large quantity of cooperating components and adding greatly to the cost and space required to install such a wave pool.

Thus, an improved wave pool design capable of generating the desired surf waves but without the above-mentioned drawbacks is desired. Ideally, the wave pool would allow for easy access to the pool, accommodate various pool sizes and shapes, provide improved visibility for bystanders, and allow for customizable generation of variety of wave shapes or types. In addition, the ideal design would be relatively inexpensive to manufacture and install and permit large amounts of users to ride or participate with the waves in the pool simultaneously.

SUMMARY

A substantially wake surf pool with a centrally located wave generation device is disclosed. In one embodiment, a water attraction may include a surface having a first elevation and a second elevation higher than the first elevation, the surface configured to receive water thereon to form a body of water, the first elevation positioned substantially at a center of the body of water and the second elevation positioned substantially at a perimeter edge of the body of water. A wave generating device is located at a position along the surface adjacent to the first elevation for generating a wave in the body of water, the wave configured to travel in the body of water from the first elevation towards the second elevation.

In another embodiment, a water attraction for the generation of waves may include a surface configured to receive water thereon for forming a body of water, the surface sloping from a first location to a second location higher in elevation than the first location. A motor is located adjacent to the first location and an elongated arm is connected with the motor. A foil is connected with the elongated arm, the foil configured to rotate in the body of water for generating a wave based upon rotation of the foil and the elongated arm due to the motor, the wave propagating towards the second location.

In still another embodiment, a wave pool may include a pool floor adapted to support water thereon to form a body of water, the pool floor having a first elevation and a second elevation higher than the first elevation, the second elevation located on an outer edge of the body of water and the first elevation located at a center of the body of water. A motor is located at the center of the body of water and a first elongated arm has a first end and a second end, the first end of the first elongated arm connected to the motor. A second elongated arm has a first end and a second end, the first end of the second elongated arm is connected to the motor. A first vertical foil is connected to the second end of the first elongated arm for generating a wave in the body of water upon rotation of the first foil in the body of water via the motor. A second vertical foil is connected to the second end of the second elongated arm for generating a second wave in the body of water upon rotation of the second foil in the body of water via the motor.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale and may be exaggerated to better illustrate the important features of the present invention. In the drawings, like reference numerals designate like parts throughout the different views, wherein:

DETAILED DESCRIPTION

The detailed description of exemplary embodiments herein makes reference to the accompanying drawings and pictures, which show the exemplary embodiments by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1:
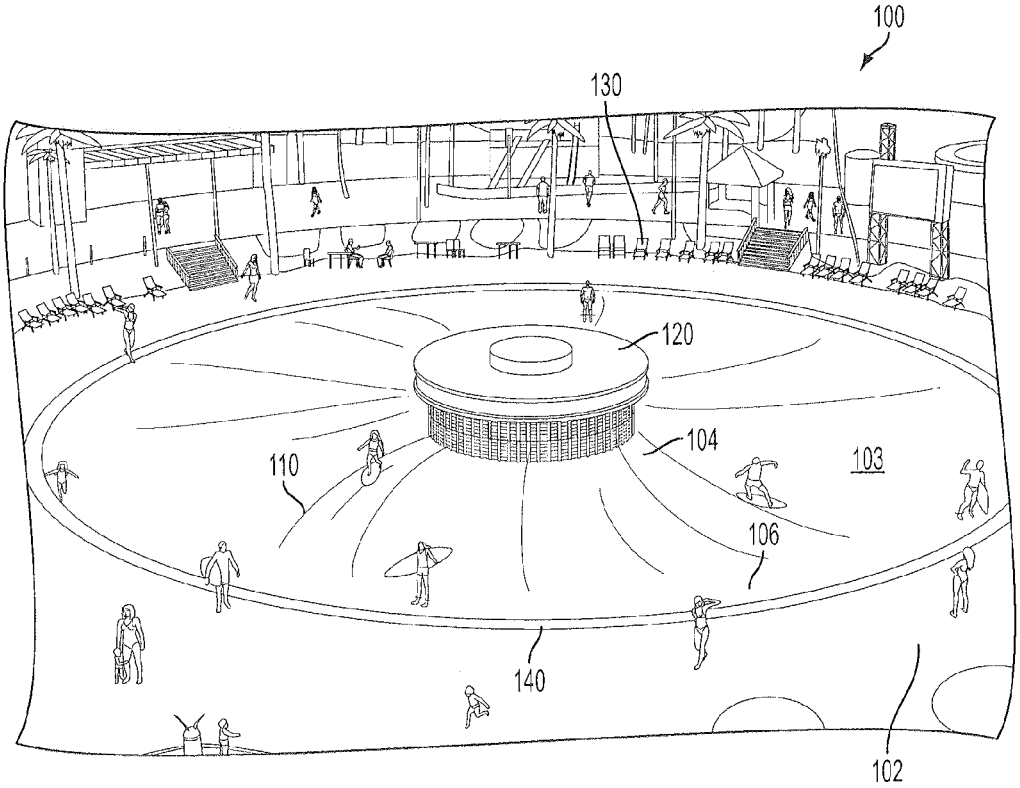
FIG. 1 shows a perspective view of a wake surf pool water attraction with centrally rotating foils for wave generation according to an embodiment of the present invention.

Turning first to FIG. 1, a perspective view of a wake surf pool water attraction 100 with centrally rotating foils for wave generation is shown. The water attraction 100 includes a housing 120 located substantially at the middle or in the center of a body of water 103 (e.g., a body of water) surrounding the housing 120. A floor surface 102 (e.g., concrete, sand, cement, etc.) of the water attraction 100 defines a surface upon which at least a portion contains or supports the body of water 103 thereon. The floor surface 102 may also extend beyond the body of water 103 so that users of the water attraction 100 may remain outside of the body of water, for example, to relax in lounge chairs 130 or simply to watch the body of water 103 and any users participating therein without entering themselves.

The floor surface 102 is disposed along incline (e.g., a linear slope), extending downwardly towards the housing 120 such that the body of water 103 has a varying depth due to the sloping of the floor surface 102. Thus, deeper water 104 is located adjacent to the housing 120 and becomes more shallow water 106 at distances further away from the housing 120. Such a configuration allows for convenient and safe use of the water attraction 100, even by users who are intimidated by deep water, since the entrance to the water attraction 100 is made via the shallow water 106 area. Users who are uncomfortable in their swimming abilities may choose to remain only at the shallow water 106 areas, without venturing into the deeper water 104 areas of the water attraction 100. A drain 140 is positioned in the floor surface 102 and surrounds the shallow water 106 area for helping prevent too much water from flowing or splashing further up the floor surface 102 than desired. Thus, individuals can chose to relax or occupy a space on the floor surface 102 beyond the drain 140 without worrying about getting drenched or wet.

As discussed in greater detail herein, the housing 120 is configured to house a wave generating apparatus or components. Waves 110 generated by the wave generating apparatus or components in the body of water 103 may be configured to travel substantially radially and/or outwardly around the housing 120 for a distance until reaching the shallow water 106 area, the drain 140 or otherwise dying or diminishing due to gravity. The waves 110 may allow users of the water attraction 100 to surf thereon, swim therethrough, or otherwise play therein, for example, with the use of an inflatable tube, body board, surfboard, etc. Depending upon the operation of the wave generating apparatus or components within the housing 120, the waves 110 may be of a variety of sizes, shapes, or types. For example, small waves may be generated in water attractions developed for younger users while large, barreling waves may be generated in water attractions developed for older users or to encourage surfing functionality.

The nature of water attraction 100 and its associated waves 110 allows for an increased number of users to simultaneously and safely participate in the water attraction 100 when compared against traditional rectangular wave pools where waves merely generate at one end and flow towards the opposite end. Moreover, the number of waves 110 may be varied depending upon the wave generating apparatus or components and/or the desired circumference or perimeter of the water attraction 100. In an alternative embodiment, the water attraction 100 may be any of a variety of shapes depending upon the desired footprint for the water attraction 100. The housing 120 for containing any wave generating equipment may still be located substantially at the center of a wave generating area in such an alternative embodiment in order to generate the desired waves as discussed.

Figure 2A:
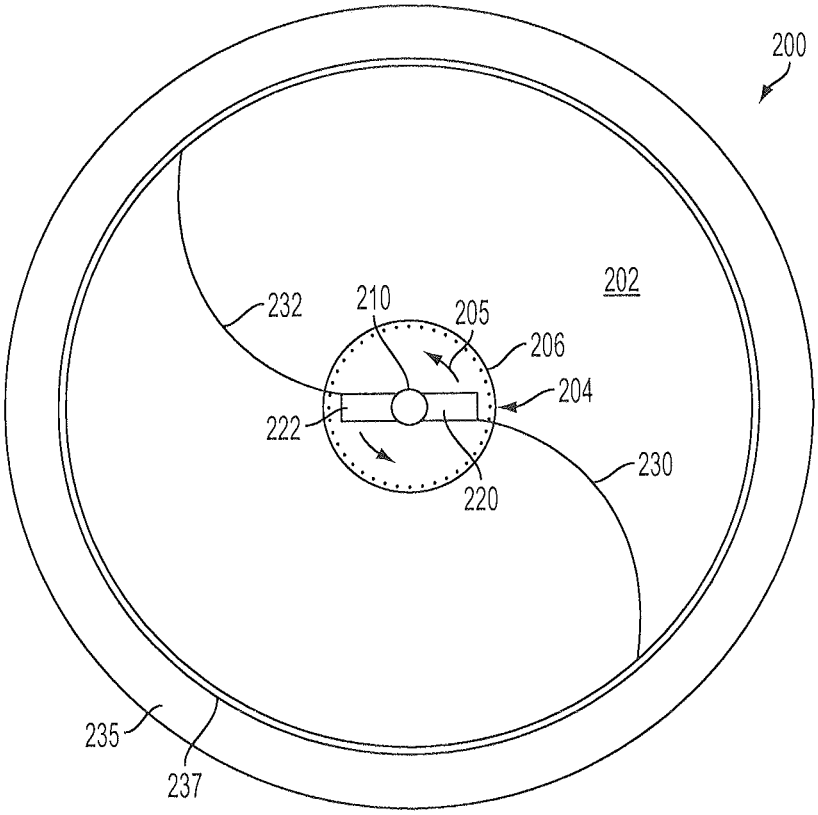
FIG. 2A shows a top view of a wake surf pool with centrally rotating foils for wave generation according to an embodiment of the present invention.

FIG. 2A shows a top view of a wake surf pool 200 with centrally rotating foils for wave generation. The surf pool 200 may include the same or similar features as previously discussed for FIG. 1. The surf pool 200 includes a body of water 202 disposed around a centrally-located wave generation apparatus 204 that may be contained within a housing 206 or other enclosure for safety purposes and/or to keep users of the surf pool 200 from interfering with its operation. The wave generation apparatus 204 includes a motor 210 and two foils (220, 222) connected with the motor and configured to rotate 205 for the production of waves (230, 232) in the body of water 202. Although the surf pool 200 is shown having two foils (220, 222) for rotating 205 in a counter-clockwise direction, an alternative embodiment may use greater or fewer foils as desired for the generation of any number of separate waves and may rotate in any direction. For example, FIG, 2D shows an alternative embodiment of a wave generating apparatus 229 using four foils (221, 223, 225, 227) shaped as compressed ovals or cylinders (e.g., with highest thickness 211, lateral distance 212, and longitudinal distance 213) and having a leading edge 228 during rotation, the same or similar as discussed throughout, that are orientated at 90 and/or 180 degrees from one another. Certain embodiments may allow for foils to alternate their direction of rotation.

The surf pool 200 has a bottom surface or floor that slopes downwardly from the outer circumference or perimeter of the surf pool 200 towards the wave generation apparatus 204, as discussed in greater detail herein. Thus, deeper water is located at a position closer to the wave generation apparatus 204 while shallower water is located at a position further from the wave generation apparatus 204. A containment area 235 with a floor that slopes back toward the body of water 202 may be used for the containment of waves and/or to prevent the undesired travel or splashing of water beyond a predetermined distance from the wave generation apparatus 204. In certain embodiments, the containment area 235 may include a drain 237, for example, such that that water is removed from the bottom surface or floor and subsequently pumped or flowed back into the body of water 202.

Figure 2B:
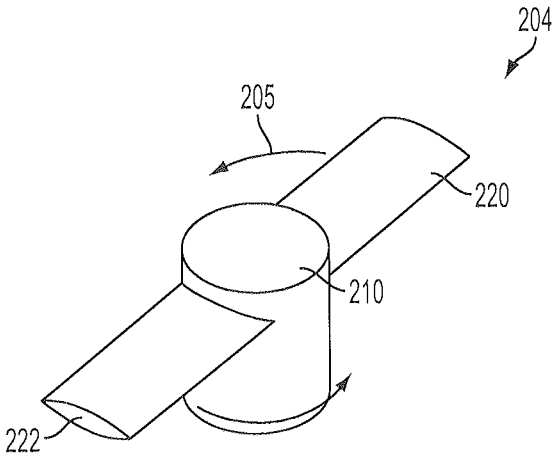
FIG. 2B shows an isometric view of a wave generating apparatus utilizing centrally rotating foils in a horizontal orientation for use in the wake surf pool of FIG. 2A according to an embodiment of the present invention.

FIG. 2B shows an isometric view of components of the wave generating apparatus 204 utilizing centrally rotating foils for use in the wake surf pool 200 of FIG. 2A. As seen, the motor 210 is located substantially in the middle between the two foils (220, 222). The motor 210 may be contained within a housing, room, or other enclosure (not shown) to help shield it from water or other environmental elements that may interfere with its operation. Any of a variety of motors or power sources may be used for causing rotation 205 of the foils (220, 222). The foils (220, 222) are configured in a substantially horizontal configuration and are shown having a compressed oval shape for slicing through the body of water 202 to create waves therein. An alternative embodiment may also or additionally utilize greater or fewer foils configured in a different orientation (e.g., vertical foils) and/or shape (e.g., a wedge or scoop shape), as discussed in greater detail herein.

Figure 2C:
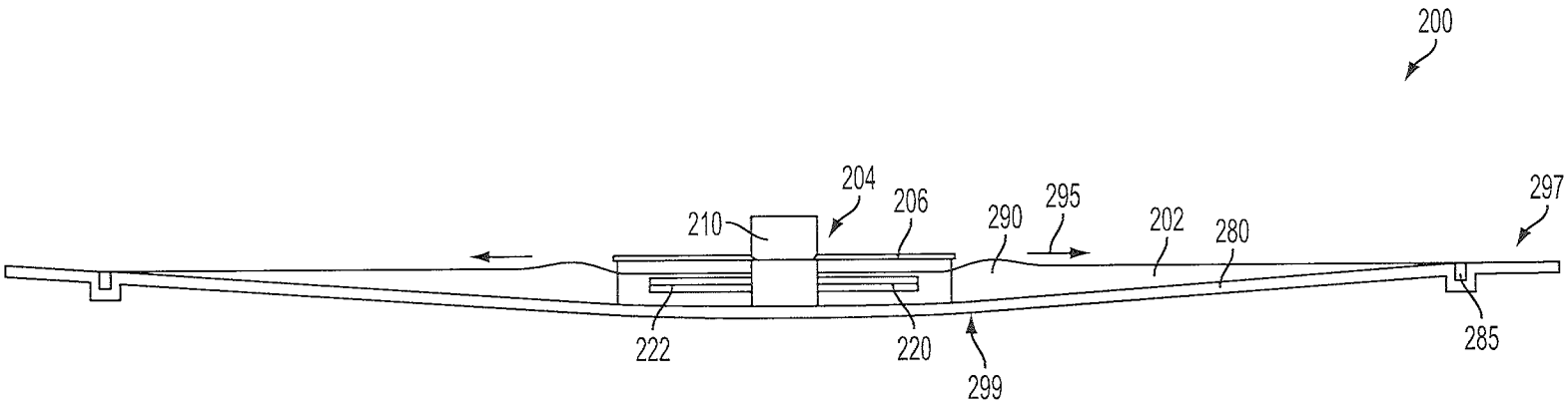
FIG. 2C shows a side view of the wake surf pool with centrally rotating foils of FIGS. 2A and 2B according to an embodiment of the present invention.
Figure 2D:
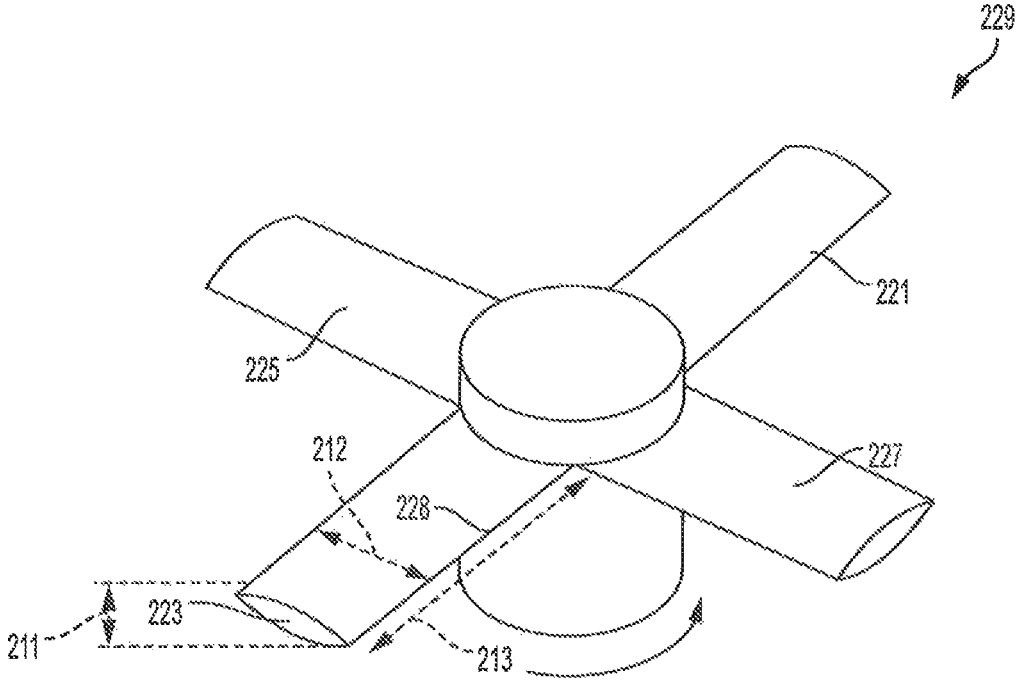
FIG. 2D shows an isometric view of a wave generating apparatus using centrally rotating foils in a horizontal orientation for use in the wake surf pool of FIG. 2A according to an embodiment of the present invention.

FIG. 2C shows a side view of the surf pool 200 with the wave generating apparatus 204 described in FIGS. 2A and/or 2B. As discussed, the wave generating apparatus 204 utilizes a motor 210 and a plurality of foils (220, 222) configured to rotate via control by the motor 210 in order to generate waves 290 in the body of water 202 of the surf pool 200. An enclosure 206 or other barrier surrounds the rotating foils (220, 222) and/or the motor 210 to prevent swimmers or surfers from interfering with the operation of the wave generating apparatus 204.

A floor 280 or bottom surface for supporting the body of water 202 has a lower elevation 299 at a first distance adjacent the water generating apparatus 204 and a higher elevation 297 at a second distance further away from the water generating apparatus 204. The floor 280 may have a linear slope between the lower elevation 299 and the higher elevation 297. In an alternative embodiment, the slope or incline between the lower elevation 299 and the higher elevation 297 may not be linear in nature (e.g., may be discrete steps, exponential, etc.). The wave 290 produced in the body of water 202 and traveling 295 away from the wave generating apparatus 204 may be formed as desired via shaping of the foils (220, 222), orientation of the foils (e.g., horizontal or vertical), the speed of rotation of the foils (220, 222), and/or the shape of the floor 280 or gradient of the floor 280 supporting the body of water 202. A drain 285 may be positioned at a predetermined length from or surrounding the wave generation apparatus 204 for halting the propagation of waves 290 or water beyond a desired distance.

Figure 3A:
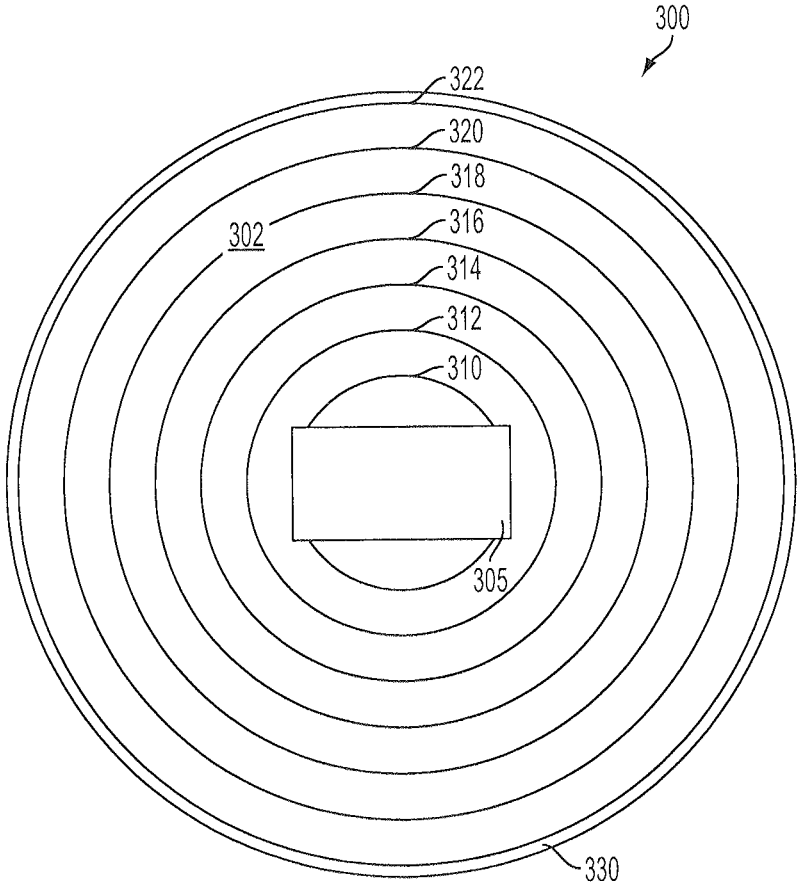
FIG. 3A shows a top view of a wake surf pool having a sloped floor level and using a wave generation apparatus positioned at the center according to an embodiment of the present invention.

Turning next to FIG. 3A, a top view of a wake pool 300 is shown for demonstrating a bottom surface 302 of the wake pool 300. The wake pool 300 may include the same or similar features as previously discussed. As seen, the wake pool 300 includes an installation 305 substantially at the center thereof. The installation 305 is configured to house at least a portion of a wake generating apparatus (e.g., a motor or pneumatic devices for producing waves via wave chambers, etc.) for the creation of waves within a body of water configured to be disposed upon the bottom surface 302 of the wake pool 300.

The bottom surface 302 of the wake pool 300 has a sloped configuration, the slope having a lower elevation near the center area of the wake pool 300 adjacent to the installation 305 and a higher elevation near the circumference or perimeter of the wake pool 300. The sloped configuration may be linear in nature, providing a gradual decrease in elevation as a user or swimmer of the wake pool 300 descends from the outer perimeter of the wake pool 300 towards the center area of the wake pool 300. For example, the floor level of the bottom surface 302 may be 0 m at a first level 322 near the perimeter, −0.1 m at a second level 320 when moving nearer to the center, −0.2 m at a third level 318 when moving even nearer to the center, −0.3 m at a fourth level 316 when moving even nearer to the center, −0.4 m at a fifth level 314 when moving even nearer to the center, −0.5 m at a sixth level 312 when moving even nearer to the center, and finally −0.6 m at a seventh level 310 when moving even nearer to the center and adjacent to the installation 305.

Thus, when filled with a body of water, the wake pool 300 gets steadily deeper as one travels from an outer edge towards the middle. A portion 330 of the bottom surface 302 disposed around the outer edge of the wake pool 300 is configured to substantially remain free from any static body of water disposed thereon, providing a wet beach for entrance by users to the wake pool 300. The portion 330 may receive splashes or temporary washes of the body of water, for example from waves generated by the components located in the installation 305.

Although the wake pool 300 is described with a shape and with specific floor levels for the bottom surface 302, any of a variety of pool shapes (e.g., rectangular, oval, wedge, etc.) may be utilized in an alternative embodiment and any of a variety of floor levels may be used for the bottom surface 302 as desired. For example, one embodiment may utilize step grading or a non-linear slope instead of a linear slope. Another embodiment may utilize differing grading for the bottom surface 302 at different areas of the wake pool 300 (e.g., a children's area of the wake pool 300 may never have the bottom surface 302 at an elevation lower than a predetermined depth while an adults area of the wake pool 300 is permitted to have the bottom surface 302 drop to the lowest elevation near the installation 305. In still another embodiment, the installation 305 for housing or containing at least a portion of the wake generating components may not be located perfectly in the center or middle of the wake pool 300, but rather at any location inward from the outer perimeter of the wake pool 300 such that waves may be generated thereat and travel outwardly therefrom.

Figure 3B:
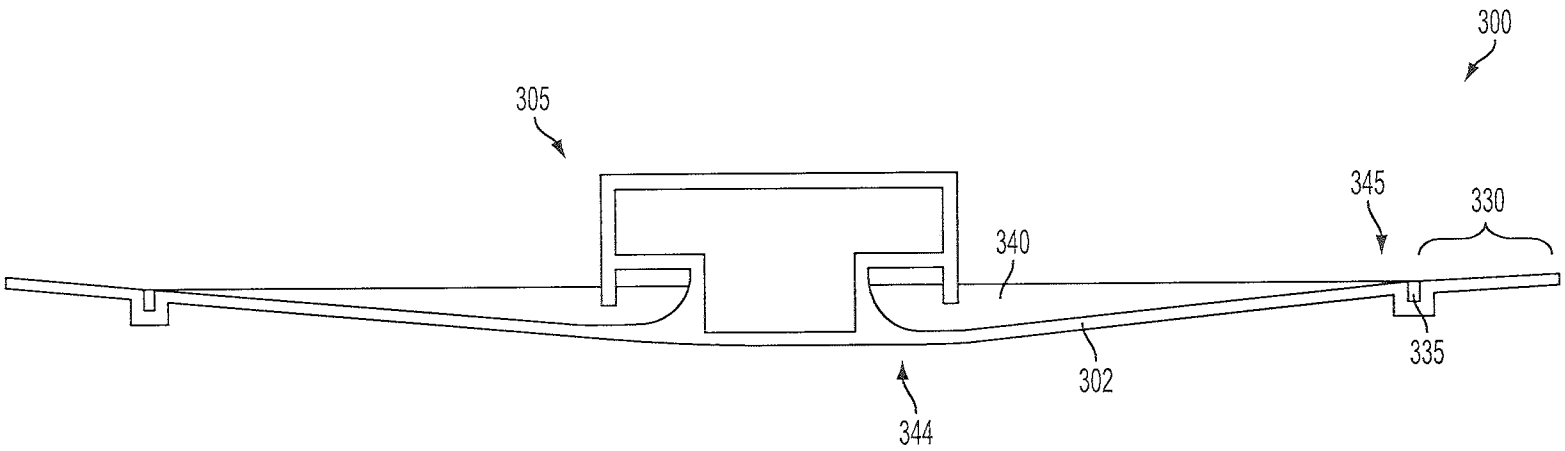
FIG. 3B shows a side view of the wake surf pool of FIG. 3A having the sloped floor level and the wave generation apparatus positioned at the center according to an embodiment of the present invention.

FIG. 3B shows the wake pool 300 of FIG. 3A from a side perspective to better illustrate the linear slope of the bottom surface 302 upon which a body of water 340 rests thereon. The installation 305 is shown in the center of the wake pool 300 and the bottom surface 302 slopes upwardly from a location 344 adjacent from the installation 305 to an outer edge or perimeter 345 of the wake pool 300. The portion 330 is shown around the outer edge or perimeter 345 of the wake pool 300 and without any static or standing water thereon. The portion 330 may be any of a variety of widths (e.g., 3 m) and may be disposed beyond a channel or slot 335 in the bottom surface 302 (e.g., the channel or slot 335 having a width of 0.25 m and a depth of 0.45 m) for helping ensure that the body of water 340 substantially does not rest upon the portion 330. The channel or slot may be or may interface with drainage equipment for evacuating any water that flows within it Although FIG. 3B demonstrates the installation 305 as utilizing centrally positioned wave chambers, for example as used in pneumatic wave generation, any of a variety of wave generation devices may be utilized in an alternative embodiment. For example, centrally rotating foils (either horizontally oriented or vertically oriented) may be utilized with the same or similar floor features or configuration discussed for FIGS. 3A and/or 3B.

Figure 4:
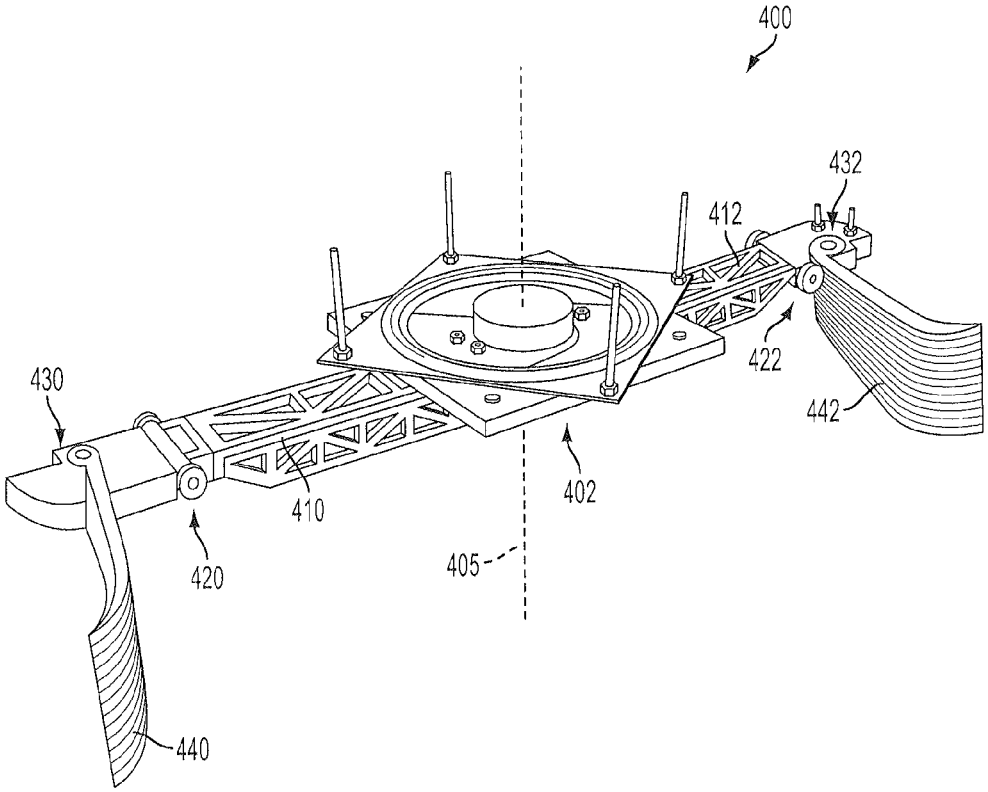
FIG. 4 shows a perspective view of a wave generation apparatus utilizing centrally rotating foils in a vertical orientation for use in a surf pool for generating waves according to an embodiment of the present invention.

Turning next to FIG. 4, a perspective view of a wave generating apparatus 400 for use in a surf pool to generate waves is shown. The apparatus 400 may include features that are the same or similar to those previously discussed. A middle portion 402 is configured to connect or interface with a power source (e.g., a motor, generator, or other equipment capable of causing rotation of the middle portion 402 about an axis 405). A first arm 410 is coupled with the middle portion 402 and extends outwardly from the middle portion 402 along a first plane. A first foil 440 is coupled with the arm 410. Thus, upon rotation of the middle portion 402 about the axis 405, the first arm 410 and the first foil 440 correspondingly rotate about the axis 405 as well.

Similarly, a second arm 412 is coupled with the middle portion 402 and extends outwardly from the middle portion 402 along the first plane, but substantially 180 degrees offset with respect to the first arm 410. A second foil 442 is coupled with the second arm 412 and thus, upon rotation of the middle portion 402 about the axis 405, the second arm 412 and the second foil 442 correspondingly rotate about the axis 405. The first foil 440 and the second foil 442 are shaped so as to generate waves in a body of water when they pass through the body of water. For example, the first foil 440 and the second foil 442 may both be vertically orientated and utilize a curved scoop configuration as shown, configured to displace water via the scoop to form waves when the first foil 440 and the second foil 442 travel through the body of water. In an alternative embodiment, the first foil 440 or the second foil 442 may utilize a variety of shapes or forms (e.g., a wedge), may be offset from a purely vertical orientation, and/or may utilize differing shapes from one another.

The arms (410, 412) may be any of a variety of lengths for positioning the foils (440, 442) a predetermined distance from the middle portion 402 or the axis 405 in order to achieve desired wave forms or to accommodate a desired pool size or shape. In one embodiment, one or more of the foils (440, 442) may be adjustably positioned along a length of their respective arms (410, 412), for example, via a motor or actuator. In another embodiment, one or more of the foils (440, 442) may have an adjustable shape, for example using movable flaps connected with a motor or actuator, such that the waves generated by one or more of the foils (440, 442) may be configured to form different profiles. Although two arms (410, 412) and two foils (440, 442) are shown for the wave generating apparatus 400, an alternative embodiment may use greater or fewer arms and/or foils (e.g., a third arm with a third foil and a fourth arm with a fourth foil may be disposed substantially +90 degrees and −90 degrees respectively offset from the first arm.

The first foil 440 is coupled with the first arm 410 via two angular adjustments, as discussed below and illustrated in FIGS. 5 and 6. A first angular adjustment 420 permits the first foil 440 to be adjustably positioned or offset via an angle with respect to a first reference plane. A second angular adjustment 430 permits the first foil 440 to be adjustably positioned or offset via an angle with respect to a second reference plane different from the first reference plane. Similarly, the second foil 442 is coupled with the second arm 412 via a first angular adjustment 422 that allows the second foil 442 to be adjustably positioned or offset via an angle with respect to a third reference plane. The second foil 442 is also coupled with the second arm 412 via a second angular adjustment 432 that allows the second foil 442 to be adjustably positioned or offset via an angle with respect to a fourth reference plane different from the third reference plane. The orientation of the foils (440, 442) via the angular adjustments (420, 430, 422, 432) may be performed after installation of the wave generating apparatus 400 (e.g., by user input via a motor connected with a controller) or may be performed during installation and fixed in position prior to use of the wave generating apparatus 400.

Figure 5:
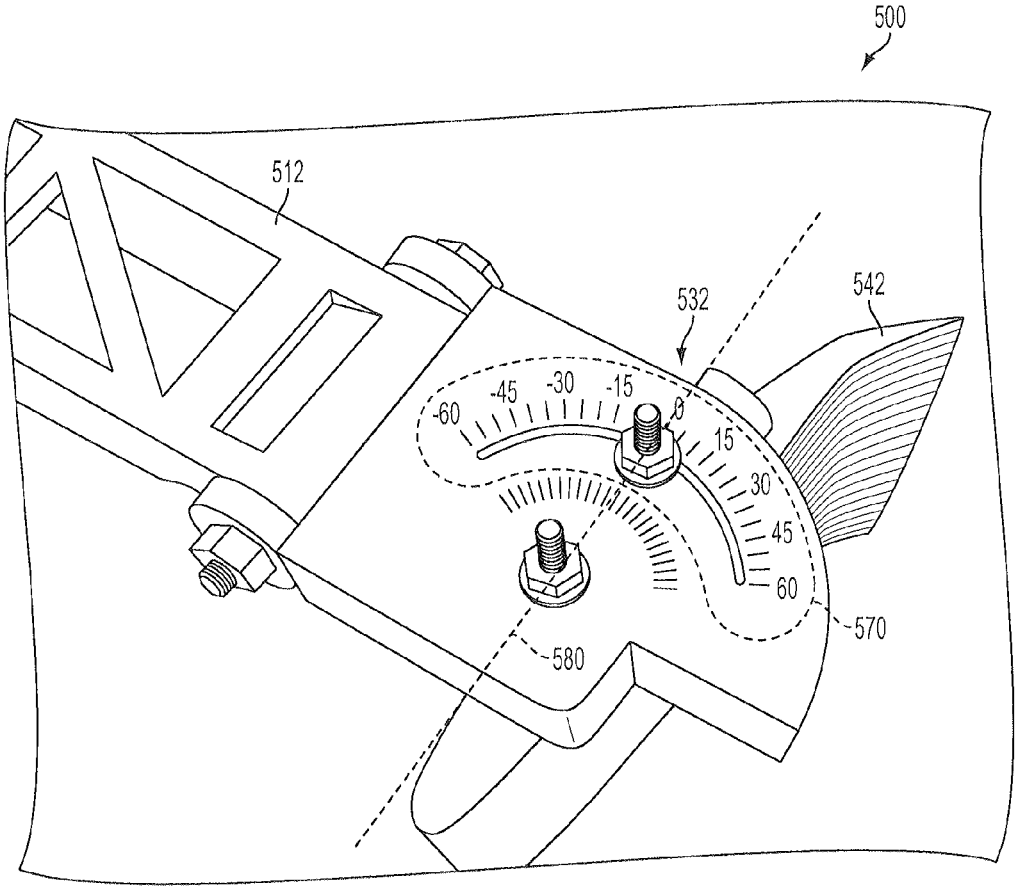
FIG. 5 shows a wave generation apparatus with an adjustable foil angle with respect to a first plane according to an embodiment of the present invention.

FIG. 5 shows a wave generating apparatus 500 configured to have an adjustable connection 532 for generation of a desired waveform in a body of water. The wave generating apparatus 500 may include features that are the same or similar to those previously discussed. The wave generating apparatus 500 includes a foil 542 connected with an arm 512 and configured to be adjusted by foil angle 570 with respect to a plane 580. As shown, the foil angle 570 may be set to orient the foil 542 with respect to the arm 512 via +/−60 degrees from the plane 580. In an alternative embodiment, the angle of adjustment may be greater than or less than +/−60 degrees. Likewise, although the plane 580 is shown substantially perpendicular to a plane containing the outwardly extending arm 512 therealong, in an alternative embodiment, the plane 580 may be oriented with the arm 512 along any of a number of different angles. The foil 542 may be adjusted to the foil angle 570 in response to user input (e.g., at a computer terminal or other control panel) or may automatically adjust (e.g., due to time of day, in response to wave size and/or shape determined via sensors, etc.).

Figure 6:
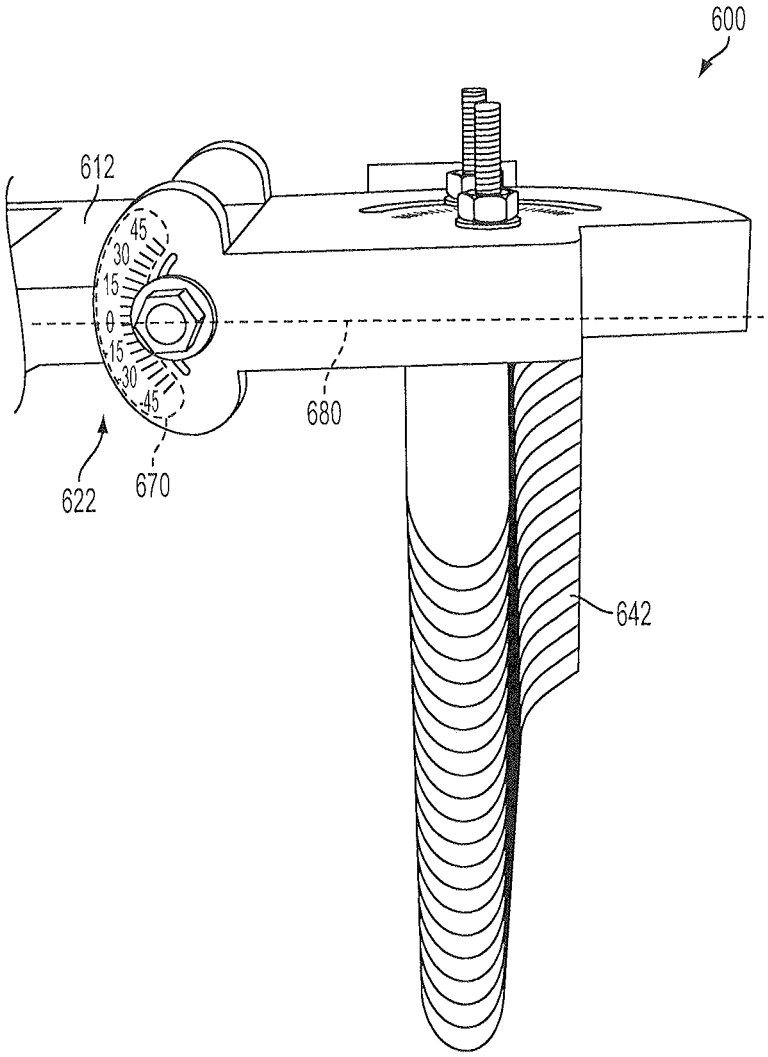
FIG. 6 shows a wave generation apparatus with an adjustable foil angle with respect to a second plane different from the first plane according to an embodiment of the present invention.

FIG. 6 shows a wave generating apparatus 600 configured to have an adjustable connection 622 for generation of a desired waveform in a body of water. The wave generating apparatus 600 may include features that are the same or similar to those previously discussed. The wave generating apparatus 600 includes a foil 642 connected with an arm 612 and configured to be adjusted by foil angle 670 with respect to a plane 680. As shown, the foil angle 670 may be set to orient the foil 642 with respect to the arm 612 via +/−45 degrees from the plane 680. In an alternative embodiment, the angle of adjustment may be greater than or less than +/−45 degrees. Likewise, although the plane 680 is shown substantially parallel to or the same as a plane containing the outwardly extending arm 612 therealong, in an alternative embodiment, the plane 680 may be oriented with the arm 612 along a different angle. The foil 642 may be adjusted to the foil angle 670 in response to user input (e.g., at a computer terminal or other control panel) or may automatically adjust (e.g., due to time of day, in response to wave size and/or shape determined via sensors, etc.).

The previous description of the disclosed examples is provided to enable any person of ordinary skill in the art to make or use the disclosed methods and apparatus. Accordingly, the terminology employed throughout should be read in a non-limiting manner. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. A water attraction comprising:

a surface configured to receive water thereon for forming a body of water, the surface sloping from a first location to a second location higher in elevation than the first location;

a motor located adjacent to the first location; and an elongated arm connected with the motor, the elongated arm shaped as a compressed cylinder having a leading edge separating a first convex surface and a second convex surface that is symmetric with the first convex surface, the elongated arm and configured to rotate in the body of water for generating a wave that propagates towards the second location based upon rotation of the elongated arm due to the motor, wherein the leading edge is the first portion of the elongated arm to contact the body of water for generating the wave by passing a first portion of the body of water over the first convex surface and a second portion of the body of water over the second convex surface, the first portion of the body of water engaging with and the second portion of the body of water to generate the wave.

2. The water attraction of claim 1 wherein the surface has a linear slope from the first location to the second location.

3. The water attraction of claim 1 further comprising:

a second elongated arm connected with the motor and substantially 180 degrees offset from the first elongated arm, the second elongated arm configured to rotate in the body of water for generating a second wave, the second wave propagating towards the second location.

4. The water attraction of claim 3 further comprising:

a third elongated arm connected with the motor and configured to rotate in the body of water for generating a third wave in the body of water; and a fourth elongated arm connected with the motor and configured to rotate in the body of water for generating a fourth wave in the body of water.

5. The water attraction of claim 4 wherein the third elongated arm and the fourth elongated arm are positioned 180 degrees from each other.

6. The water attraction of claim 4 wherein the third is positioned 90 degrees from the first and the fourth is positioned 90 degrees from the second.

7. The water attraction of claim 1 further comprising a drain located in the surface at least partially at the second location of the surface.

* * * * *